US009086077B2

(12) United States Patent
Boufflert et al.

(10) Patent No.: US 9,086,077 B2
(45) Date of Patent: Jul. 21, 2015

(54) TURBINE MACHINE CASING WITH REINFORCED SEALING

(75) Inventors: Sebastien Boufflert, Louviers (FR); Philippe Bourdin, Saint Just (FR); Vincent Langlois, La Haye-Malherbe (FR); Patrice Fayolle, Saint Marcel (FR)

(73) Assignee: SNECMA, Paris (FR)

( * ) Notice: Subject to any disclaimer, the term of this patent is extended or adjusted under 35 U.S.C. 154(b) by 685 days.

(21) Appl. No.: 13/391,977

(22) PCT Filed: Jul. 21, 2010

(86) PCT No.: PCT/FR2010/051536

§ 371 (c)(1), (2), (4) Date: May 2, 2012

(87) PCT Pub. No.: WO2011/023873

PCT Pub. Date: Mar. 3, 2011

(65) Prior Publication Data

US 2012/0230816 A1 Sep. 13, 2012

(30) Foreign Application Priority Data

Aug. 25, 2009 (FR) ..... 09 55778

(51) Int. Cl.
*F04D 29/42* (2006.01)

(52) U.S. Cl.
CPC ..... *F04D 29/42* (2013.01)

(58) Field of Classification Search
CPC ..... F01D 25/14; F01D 25/145; F01D 25/24; F01D 25/243; F04D 1/066; F04D 29/40
USPC ..... 415/177, 178, 203, 204, 205, 206; 417/423.14
See application file for complete search history.

(56) References Cited

U.S. PATENT DOCUMENTS

| | | | | |
|---|---|---|---|---|
| D589,136 | S | 3/2009 | Kenyon et al. | |
| D589,137 | S | 3/2009 | Kenyon | |
| D589,138 | S | 3/2009 | Kenyon et al. | |
| 2008/0304960 | A1 * | 12/2008 | Cvjeticanin et al. | 415/200 |
| 2009/0053051 | A1 | 2/2009 | Cvjeticanin | |
| 2009/0136341 | A1 | 5/2009 | Kenyon | |
| 2010/0132711 | A1 | 6/2010 | Kenyon | |

FOREIGN PATENT DOCUMENTS

| | | |
|---|---|---|
| DE | 10 2007 009 781 | 8/2008 |
| EP | 1 571 349 | 9/2005 |
| WO | 2007 048205 | 5/2007 |

OTHER PUBLICATIONS

International Search Report Issued Nov. 3, 2010 in PCT/FR10/051536 Filed Jul. 21, 2010.

* cited by examiner

*Primary Examiner* — Edward Look
*Assistant Examiner* — Christopher J Hargitt
(74) *Attorney, Agent, or Firm* — Oblon, McClelland, Maier & Neustadt, L.L.P.

(57) ABSTRACT

The sealing of a turbine casing is reinforced by decoupling a fastening flange from a remainder of a housing. The casing includes a body that is externally reinforced by axial ribs that are connected to an annular rib and the fastening flange is attached to the annular rib by an annular wall portion that is thinner than the annular rib and than the flange.

6 Claims, 1 Drawing Sheet

TURBINE MACHINE CASING WITH REINFORCED SEALING

The invention relates to a turbine machine casing within which high-pressure fluid is contained, such as for example a casing of a centrifugal pump or of a turbine. The invention serves simultaneously to reduce mechanical stress and deformation of the casing, to facilitate fabrication and mounting of the casing, and to improve its sealing in use.

A casing of the type that the invention seeks to improve is known comprising a body that is obtained essentially by molding, within which there is defined a cavity that houses the centrifugal stage of the rotor and that is shaped to define an outlet volute, particularly a sloping volute. The casing body has two annular portions of different diameters. The smaller-diameter portion is designed to house a portion of the rotor. The larger-diameter portion houses a centrifugal impeller and is provided with an annular fastening flange for bolting to another casing, complementary thereto. In order to stiffen the casing, axial ribs are provided on the outside of the casing by molding (i.e. stiffeners are provided that extend parallel to its axis), which ribs are regularly distributed circumferentially and extend between the flange and the smaller-diameter portion. Those integrally-molded axial ribs may present a certain amount of height in the radial direction, thereby giving the casing body the desired stiffness.

The flange serves to center the two casings, and a gasket inserted between them provides sealing relative to the outside. The axial ribs serve to limit the deformation of the casing without increasing its wall thickness. The axial ribs also serve to limit deformation of the internal web, i.e. the connection of internal material between the smaller-diameter and the larger-diameter portions of the volute. This web zone is very highly stressed since it absorbs all of the deformation of the outlet volute that results from the effects of pressure. The axial ribs therefore reduce the level of stress in the web.

Because of the axial ribs, deformation of the casing is relatively limited and stresses in the web between the diffuser outlet of the volute are relatively contained. In contrast, since the ribs start at the flange, they limit the number of bolts that can be used and they make the flange more complicated to fabricate. This may give rise to problems of sealing the pump housing because of the number of bolts being too small. The casing tends to expand under the effect of pressure and it stresses the flange, tending to make it pivot on its bearing surface, which can give rise to external leakage, to a loss of centering, or even to bolts rupturing.

The invention makes it possible to conserve the advantages of relatively tall axial ribs that provide good overall rigidity to the housing, while nevertheless enabling the flange to be decoupled.

More particularly, the invention provides a turbine machine casing of the type comprising a body externally reinforced by axial ribs that are regularly spaced apart circularly and that extend as buttresses between two annular portions of different diameters, the larger-diameter portion being provided with an annular fastening flange, the casing being characterized in that beside the larger-diameter annular portion the ends of the axial ribs are connected to an annular rib, and in that the annular rib is connected to said fastening flange via an annular wall portion that is thinner than said annular rib and than said flange.

The configuration and the connection of the axial ribs are the result of the casing being molded.

According to the invention, a relatively thin annular zone is created in the vicinity of the flange. This zone is therefore more flexible, other things being equal, and therefore deforms under the effect of pressure so as to absorb the movements between the flange and the remainder of the casing that is more rigid because of the presence of the axial ribs.

According to another advantageous characteristic, said annular rib is defined as an external radial extension of an internal volute web.

Furthermore, and optionally, said thinner annular wall portion is defined radially outside a diffuser outlet.

In an embodiment, said axial ribs extend over the outside wall of a sloping volute. They are continuously attached to the outside wall of the casing, including the volute.

As mentioned above, the invention is equally applicable to a centrifugal pump casing and to a turbine casing.

The invention can be better understood and other advantages appear more clearly in the light of the following description given purely by way of example and made with reference to the accompanying drawing, in which.

Figure 1:
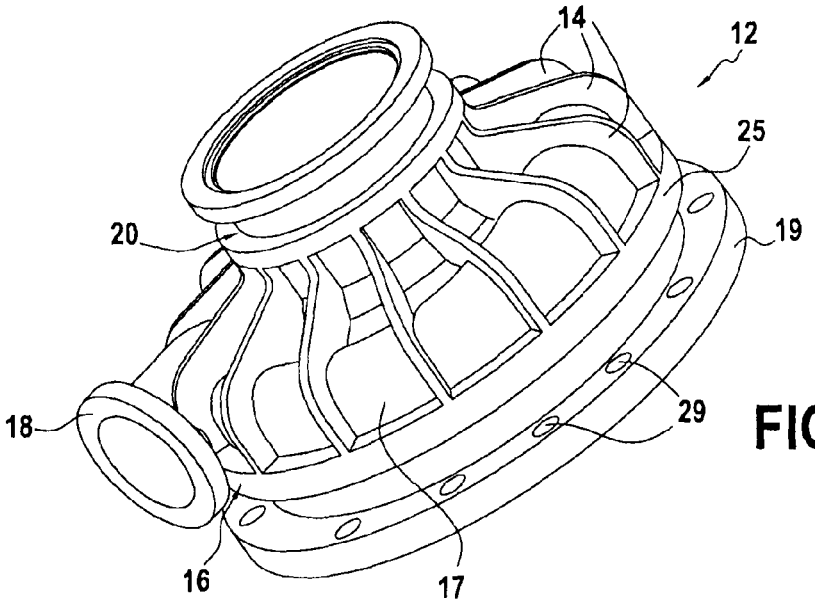
FIG. 1 is an outside perspective view of a casing of the invention.

In the drawing, there can be seen a centrifugal pump casing comprising a molded metal body 12 presenting axial ribs 14 that are integrally molded therewith on its outside, which axial ribs 14 are regularly spaced apart circumferentially and extend as buttresses between two annular portions 16 and 20 of different diameters. The larger-diameter portion 16 includes a sloping volute 17 terminating at a tangential outlet 18 through which the fluid under pressure is discharged, and an annular fastening flange 19.

Figure 2:
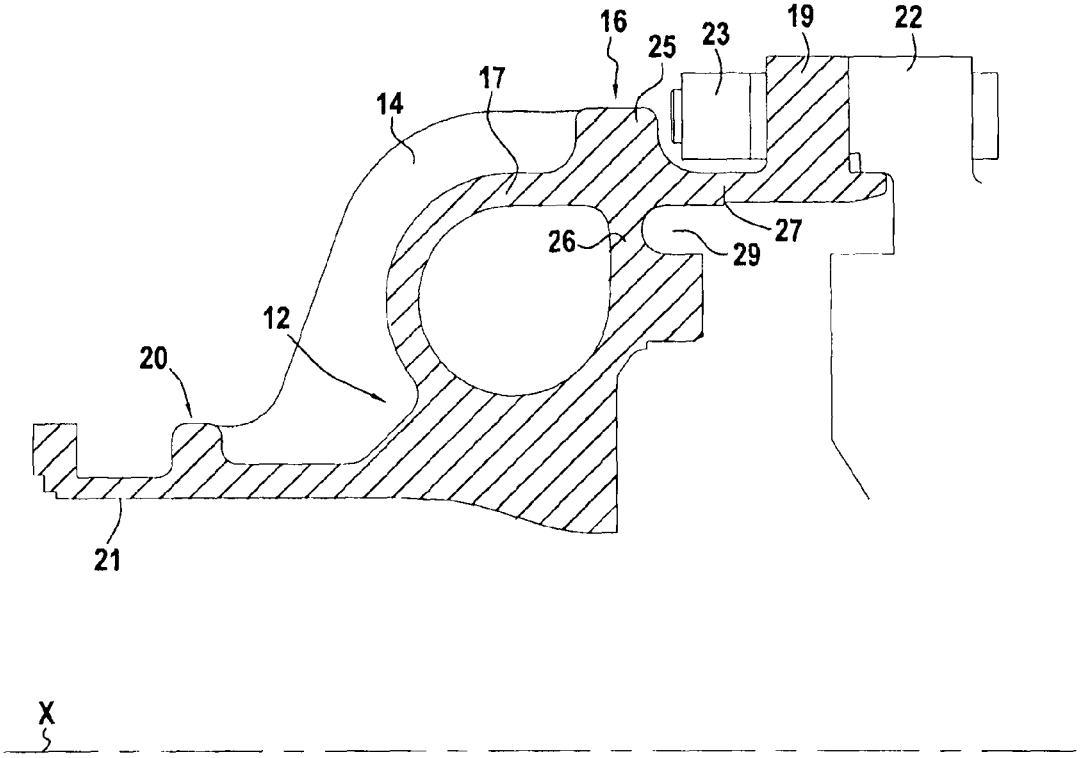
FIG. 2 is a half-section of the same casing on a plane containing the axis of rotation X.

In FIG. 2, the casing is shown shaded and a portion of a complementary casing 22 is drawn in fine lines, being assembled to the flange 19 by bolts 23.

According to an important characteristic of the invention, beside the larger-diameter annular portion 16, the ends of the axial ribs are united by molding with an outwardly-projecting annular rib 25, and this rib is connected by molding with said fastening flange 19 via a substantially cylindrical annular wall portion 27. This annular wall portion is thinner than the rib 25 and thinner than the flange 19, as can be seen in FIG. 2. Furthermore, the flange 19 is provided with a certain number of holes 29 that are regularly spaced apart circularly. The casing is designed to be bolted to the complementary casing 22 via the flange, with each hole receiving a bolt 23. A gasket is inserted between this flange and the flange of the complementary casing.

According to another advantageous characteristic, the rib 25 is defined as an external radial extension of an internal web 26 separating the volute 17 from the diffuser outlet 29. The web absorbs the deformations of the volute that are due to the effects of pressure. It thus constitutes a portion that is highly stressed. The presence of the rib 25 reinforces this zone.

According to another advantageous characteristic, the thinner annular wall portion 27 is defined radially outside the diffuser outlet 29.

It should be observed that the axial ribs 14 extending across the outer wall of the sloping volute 17 are connected to the casing by molding between the outside wall of the cylindrical portion 21 of said smaller-diameter portion, and the annular rib 25. The portion of the casing that is reinforced by the axial ribs is thus extremely rigid, and according to the invention, this portion is decoupled from the flange 19 by the annular wall portion 27. As a result, it is this portion that tends to bend under the effect of internal pressure while avoiding deformation affecting the flange itself. As a result, the flange no longer tends to pivot relative to the flange of the complementary casing and is no longer stressed in a manner that might otherwise cause the join plane to open and give rise to leaks.

Furthermore, the flange 19 is simpler to make and the number of axial ribs 14 does not limit the number of holes 29 that it is possible and desirable to form through the flange in order to ensure that the gasket is clamped to the desired extent.

As mentioned above, this concept may be transposed to a turbine casing.

The invention claimed is:

1. A turbine machine casing comprising:

a body externally reinforced by axial ribs that are regularly spaced apart circularly and that extend as buttresses between two annular portions of different diameters, a larger-diameter portion including an annular fastening flange, wherein on a side of the larger-diameter annular portion the ends of the axial ribs are connected to an annular rib, and the annular rib is connected to the fastening flange via an annular wall portion that is thinner than each of the annular rib and the flange.

2. A turbine machine casing according to claim 1, wherein the annular rib is defined as an external radial extension of an internal web.

3. A turbine machine casing according to claim 1, wherein the thinner annular wall portion is defined radially outside a diffuser outlet.

4. A turbine machine casing according to claim 1, wherein the axial ribs extend over an outside wall of a sloping volute.

5. A centrifugal pump, comprising a casing according to claim 1.

6. A turbine, comprising a casing according to claim 1.

* * * * *